United States Patent [19]

Watanabe

[11] Patent Number: 4,739,372

[45] Date of Patent: Apr. 19, 1988

[54] IMAGE FORMING APPARATUS

[75] Inventor: Junji Watanabe, Yokohama, Japan

[73] Assignee: Kabushiki Kaisha Toshiba, Kawasaki, Japan

[21] Appl. No.: 885,131

[22] Filed: Jul. 14, 1986

[30] Foreign Application Priority Data

Jul. 17, 1985 [JP] Japan ..... 60-157892

[51] Int. Cl.[4] ..... G03G 15/04

[52] U.S. Cl. ..... 355/25; 355/14 R; 355/8

[58] Field of Search ..... 355/25, 23, 24, 26, 355/14 R, 3 R, 7, 8

[56] References Cited

U.S. PATENT DOCUMENTS 4,098,551 7/1978 Komori et al. ..... 355/26 X 4,595,273 6/1986 Watanabe et al. ..... 355/8 X 4,600,293 7/1986 Watanabe ..... 355/8

*Primary Examiner*—R. L. Moses

*Attorney, Agent, or Firm*—Schwartz, Jeffery, Schwaab, Mack, Blumenthal & Evans

[57] ABSTRACT

An image forming apparatus is disclosed that provides dual-page copies of a document that are free of offset. The apparatus includes a fixed scale that provides a scanning start position for the first page of the document, and a movable scale that provides a scanning end position for the second page of the document. The document is placed on a document table with a first edge of the document positioned with respect to the fixed scale. An operator controls the positioning of the movable scale to indicate the second edge of the document. The copy operation is controlled based on a prescribed range for the pages of the document that is defined by the position of the fixed and movable scales.

6 Claims, 16 Drawing Sheets

IMAGE FORMING APPARATUS

BACKGROUND OF THE INVENTION

1. Field of the Invention

The present invention relates to an image forming apparatus which is employed in an electronic copying machine.

2. Description of the Prior Art

There has been development and practical application of copying machines which can effect successive copying, one page at a time, of two pages of a thick document such as a book (dual-page copying).

However, with a thick document such as a book, although the book size may be B5, its width when it is opened up and placed on a document table is less than B4 (=2 times of B5). And so the result is a copy with the right-hand page offset by an amount $\delta$ as shown in FIGS. 1A and 1B. In most cases, the normal procedure in copying books is that, for each page, the book is set in position manually taking as reference an edge that is parallel to the spine. In apparatus in which this is done, there is a gap $\delta$ at the right-hand edge in the copy of the right-hand page and it is not possible to effect copying taking this edge as a reference.

SUMMARY OF THE INVENTION

It is an object of the present invention to provide an image forming apparatus which permits copying to be effect taking edges as reference in dual-page copying of thick document as books and so permits forming of fine images free of offset.

According to one aspect of the present invention, there is provided an image forming apparatus comprising:

a document table on which a document having first and second areas is set;

optical scanning means for optically scanning the document at a prescribed range;

first scale means fixedly provided at one end of the document table as a indicator for setting a first edge of the document;

second scale means movably provided along the document table for indicating a second edge opposed the first edge of the document;

displacement means for moving the second scale means to a position corresponding to the second edge of the document;

means for controlling the scan of the optical scanning means, to optically scan the first area of the document at the prescribed range defined by referring the first scale means, and to optically scan the second area of the document at the prescribed range defined by referring the second scale means positioned at the second edge; and means for producing respective copies of each area of the document respectively scanned by the optical scanning means.

BRIEF DESCRIPTION OF THE DRAWINGS

FIGS. 2 through 17B show one embodiment of the present invention, in which:

FIG. 2 is a perspective view showing how a book is set in place;

FIG. 6 is an external perspective view of a copying machine;

FIG. 7 is a schematic side view of the internal layout of the copying machine as shown in FIG. 6;

FIG. 8 is a top plan view showing the layout of a operation panel of the copying machine;

FIG. 9 is a perspective view showing the arrangement of the various drive motors used for the copying machine;

FIG. 10 is a perspective view showing in outline the drive mechanism of the optical system used for the copying machine;

FIG. 11 is a perspective view showing in outline the drive mechanism of the pointers used for the copying machine;

FIG. 12 is a block diagram of the overall control circuit;

FIG. 13 is a block diagram of the main processor group;

FIG. 14 is a block diagram of the first sub-processor group;

FIG. 15 is a block diagram of the second sub-processor group;

FIG. 16 is an outline block diagram of the pulse motor control circuit; and

FIGS. 17A and 17B explain how the speed of the pulse motor is controlled.

DETAILED DESCRIPTION OF THE PREFERRED EMBODIMENT

An explanation follows of an embodiment of the invention referring to the accompanying drawings.

Figure 6:
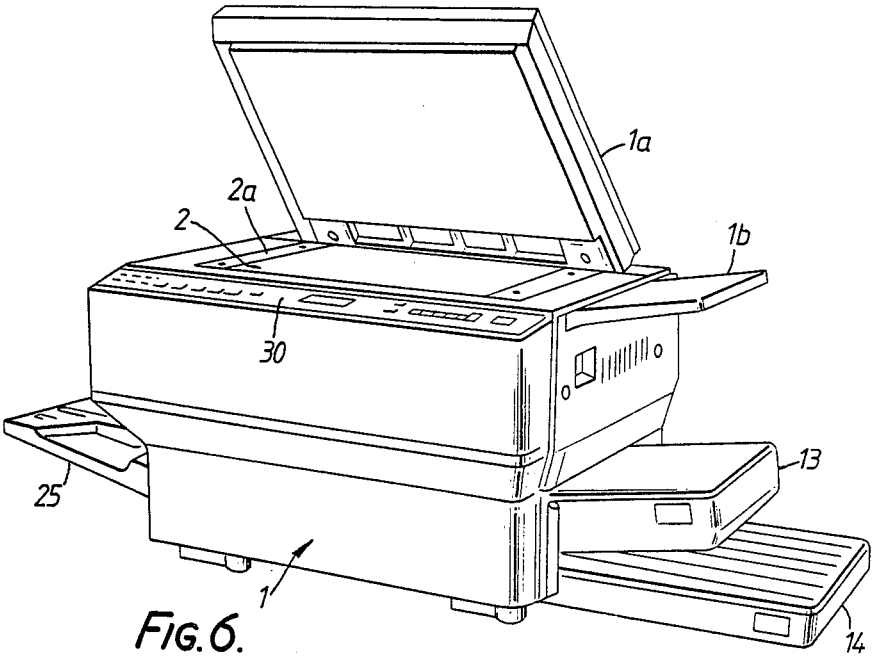
Figure 7:
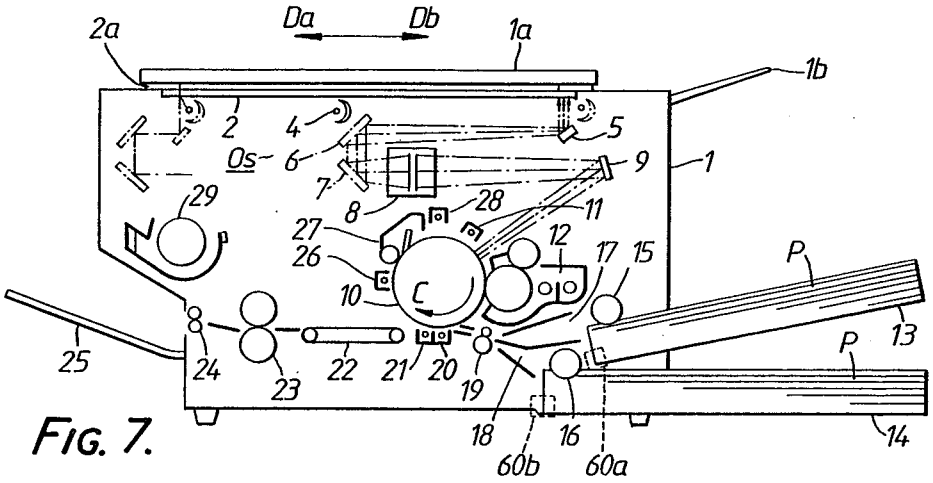

FIGS. 6 and 7 show an image forming apparatus, for example, an electrostatic copier. A document table 2 consisting of transparent glass which supports the document to be copied, is provided at the top of a main body 1 of the copier. A fixed scale 2*a* as a indicator for setting one edge of the document is fixed at one end of document table 2 along the longitudinal direction thereof. This document table 2 is provided with a cover 1*a* which can be opened and closed, and which covers documents placed on the document table 2. A work table 1*b* is provided to the right of document table 2, projecting from main body 1. An optical scanning unit Os such that it can move in the directions indicated by the arrows Da and Db, is provided below document table 2. Optical scanning unit Os consists of an exposure lamp 4 which irradiates the document placed on document table 2, and mirrors 5, 6 and 7 which direct the light reflected from the document. When optical scanning unit Os moves from left to right in FIG. 7, it scans the document by exposing it to light. Mirrors 6 and 7 move at half the speed of mirror 5 so as to maintain an optical path of constant length. The light reflected from the document as it is scanned by optical scanning unit Os, i.e., the light from the exposure lamp 4 reflected back from the document, after being reflected by mirrors 5, 6 and 7, passes through a lens block 8 for varying the enlargement rate of the copy. After being reflected by a mirror 9, the reflected light is directed to a photosensitive drum 10. An image of the document is then formed on the surface of photosensitive drum 10.

Photosensitive drum 10 rotates in the direction of an arrow C. First, the surface of drum 10 is electrically charged by a main charger 11. Next, an electrostatic latent image of the document is formed on drum 10 by slit exposure. This electrostatic latent image is rendered visible when the toner image is formed by the deposition of toner effected by a developing unit 12. Paper P is extracted one sheet at a time by a feed roller 15 or 16 from an upper cassette 13 or lower cassette 14, whichever has been selected. The extracted paper P is guided via a paper guide path 17 or 18 to a pair of aligning rollers 19 and is fed by this pair of rollers 19 to the image transfer station. Cassettes 13 and 14 are so arranged that they can be readily inserted or withdrawn from main body 1. One of cassettes 13 and 14 is selected by means of an operation panel (to be described later). The cassette size is detected by cassette size sensors **60*a* and 60*b* provided low down on the right of main body 1. These sensors 60*a* and 60*b*** are made up of a plurality of microswitches which switch on/off according to the different size of the cassettes inserted.

Paper P which has been fed to the image transfer station, adheres closely to the surface of photosensitive drum 10 and by this means the toner image on photosensitive drum 10 is transferred by the action of a transfer charger 20 to paper P. Paper P on to which the toner image has been transferred is separated from drum 10 by the action of a separation charger 21 and carried on a conveyer belt 22. It is then fed to a pair of fixing rollers 23 provided at the end of conveyer belt 22 by means of the passage through these rollers of paper P, the toner image on paper P is fixed. After fixing, paper P is discharged by a pair of exit rollers 24 on to a receiving tray 25 provided outside main body 1. After the transfer of the toner image, the residual electric charge is removed from photosensitive drum 10 by a charge remover 26 and any residual toner is removed by a cleaner 27. Any image remaining on the drum is erased by a discharge lamp 28 and the drum is then returned to its initial state. Numeral 29 designates a cooling fan to prevent the temperature inside of main body 1 from rising.

Figure 8:
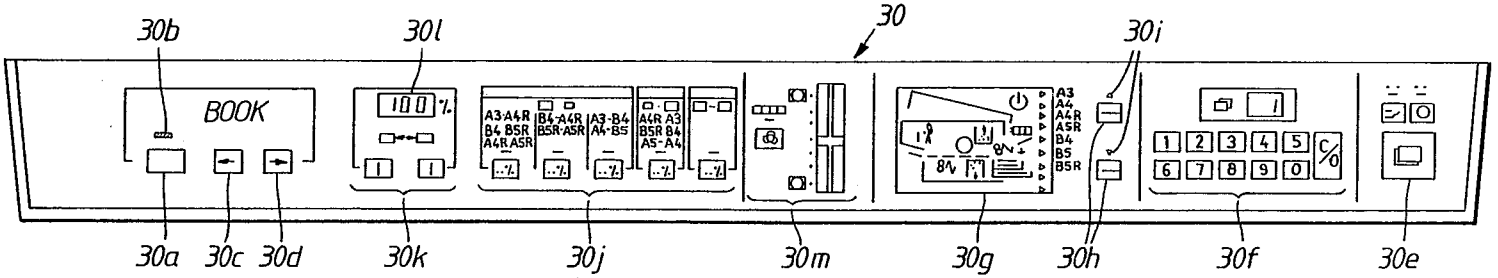

FIG. 8 shows a operation panel 30 provided at the top of main body 1. On this panel are disposed a COPY button **30*e* for initiating the copy operation, a number key unit 30*f* for setting the number of copies, a display 30*g* indicating the operating state, paper jam, etc., cassette selecting keys 30*h* for selecting either upper cassette 13 or lower cassette 14, indicators 30*i* indicating which cassette has been selected, enlargement rate setting keys 30*j* which set the rate of enlargement or reduction in prescribed steps, ZOOM keys 30*k* which set the rate of enlargement or reduction without the constraint of the prescribed steps, a rate display unit 30*l* which displays the rate that has been set and a density setter 30*m* which sets the density of the copy. Reference numeral 30*a* denotes a book designation key for designating that the document to be copied is a book, numeral 30*b* designates an indicator which indicates that the book copying mode has been designated by book designation key 30*a*, numeral 30*c* designates a displacement key which causes a scale 53 provided on a first carriage 41*a* of optical scanning unit Os to move to the left (the direction Da in FIG. 10) and numeral 30*d* designates a displacement key which causes scale 53 provided on first carriage 41*a* to move to the right (the direction Db in FIG. 10**).

Figure 9:
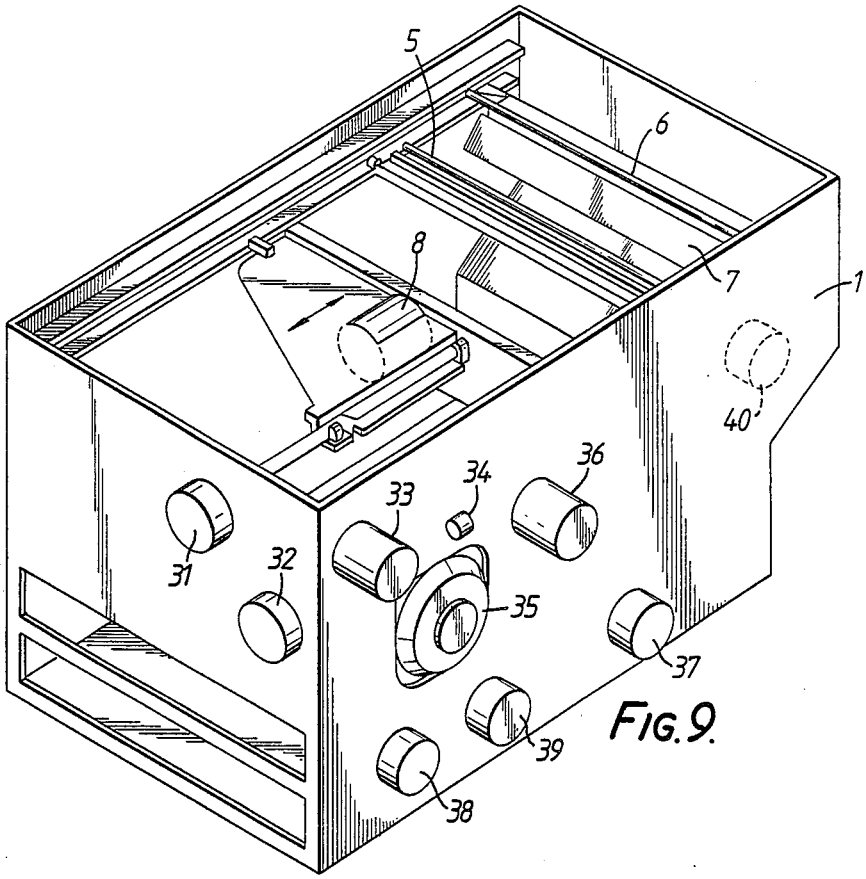

FIG. 9 is a perspective view showing the arrangement of the drive sources (pulse motors) for each part of this embodiment. An enlargement/reduction rate-changing motor 31 varies the position of lens block 8. A motor 32 is for varying the distance between mirror 5 and mirror 6 (optical path length) when the enlargement/reduction rate is altered. A scanning motor 33 is for moving exposure lamp 4 and mirrors 5, 6 and 7, so that the document can be scanned. A shutter motor 34 is for moving the shutter (not shown in the drawings) for adjusting the width of the charge applied by main charger 11 to photosensitive drum 10 when the enlargement/reduction rate is altered. A developer motor 35 is for driving the developing rollers etc. of developing unit 12. A drum motor 36 is for driving photosensitive drum 10. A fixing motor 37 is for driving pair of fixing rollers 23 and pair of exit rollers 24. A paper feed motor 38 is for driving feed rollers 15 and 16. A paper transport motor 39 is for driving pair of aligning rollers 19. A fan motor 40 is for driving cooling fan 29.

Figure 1A:
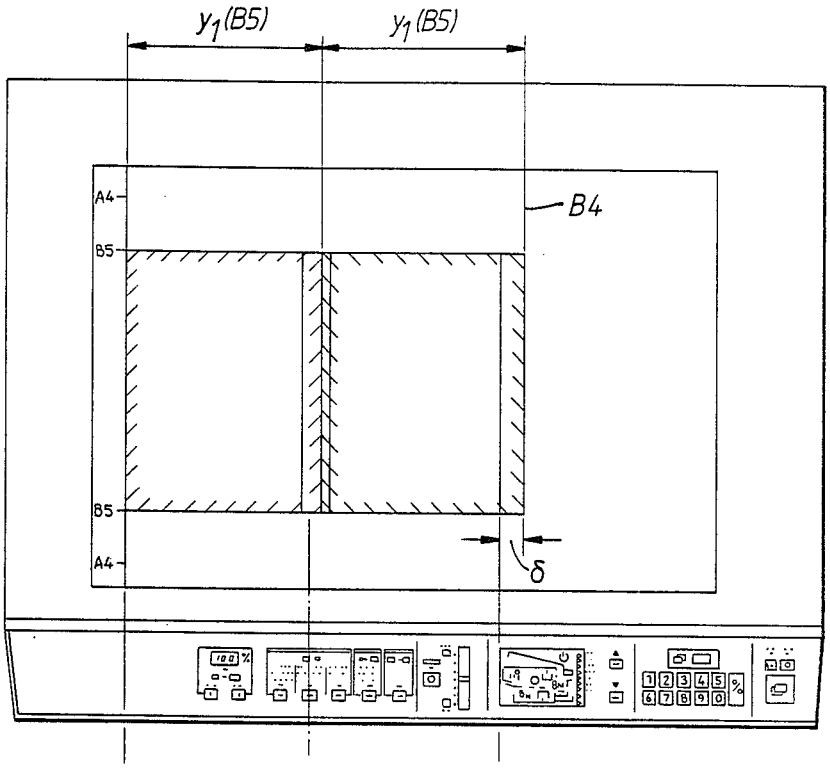
FIG. 1A. (PRIOR ART)
FIG. 1A is a plan view of a document table showing an explanation of dual copying in prior art.
Figure 1B:
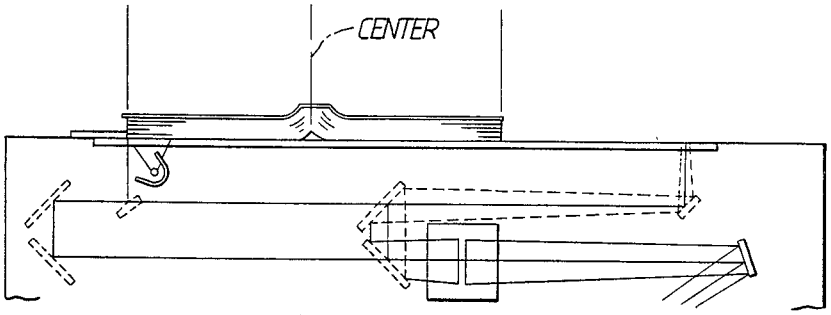
FIG. 1B. (PRIOR ART)
FIG. 1B is a schematic elevation of the document table showing the explanation of dual copying in prior art as shown in FIG. 1A.
Figure 2:
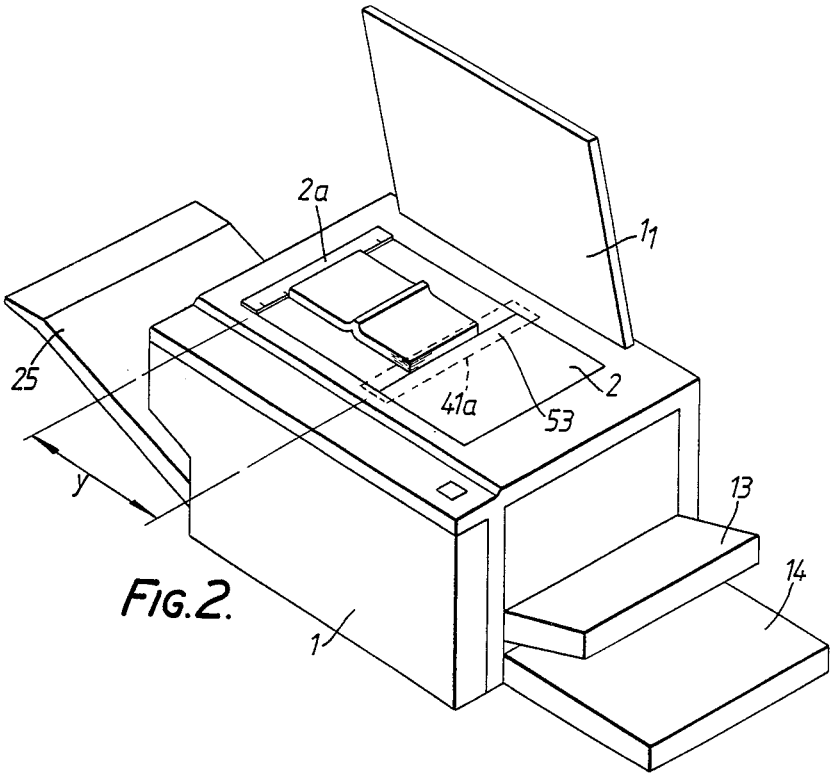
Figure 10:
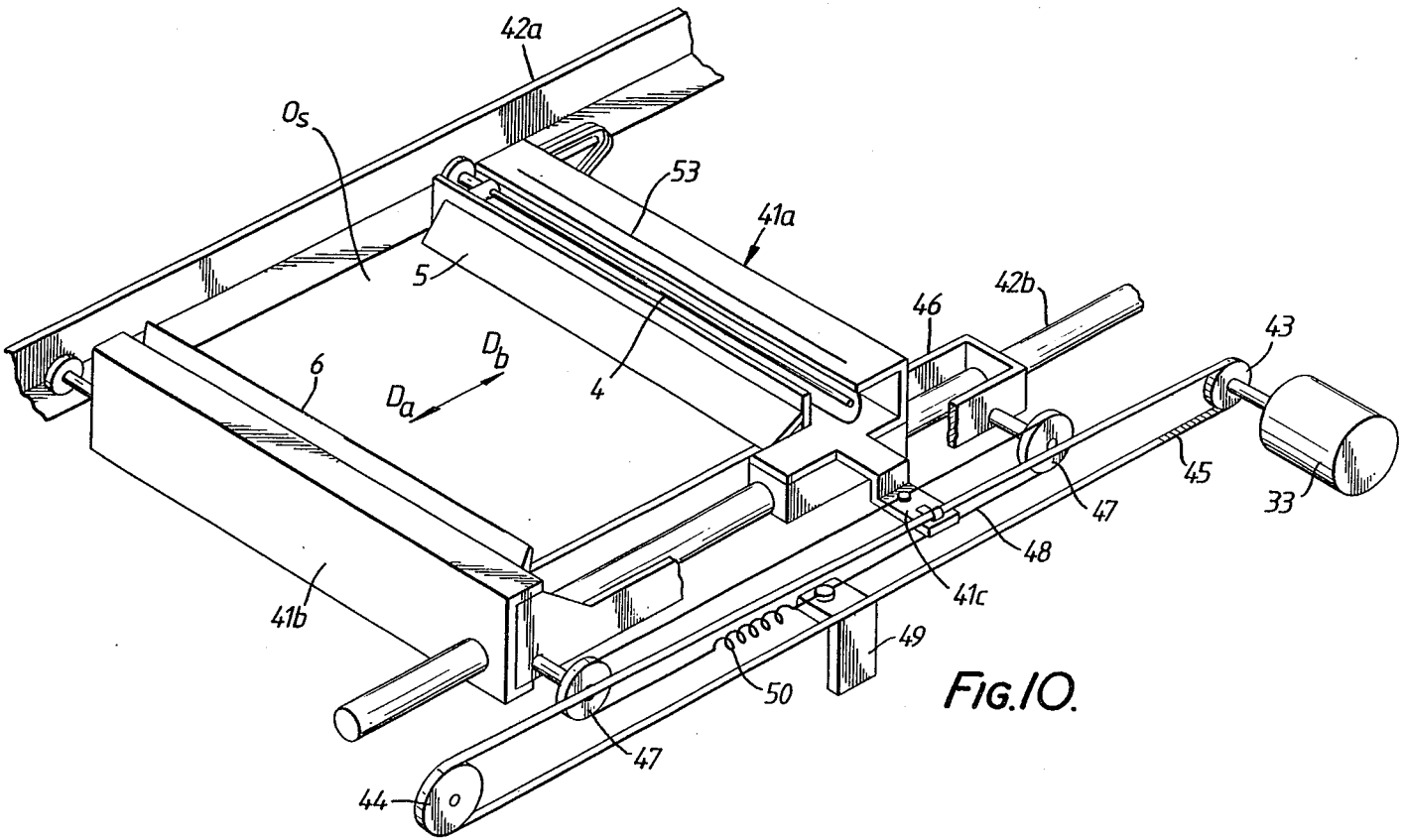

FIG. 10 is a perspective view showing the scanning mechanism for moving optical scanning unit Os consisting of exposure lamp 4 and mirrors 5, 6 and 7 along document table 2. Exposure lamp 4 and mirror 5 are fixed to first carriage **41*a* and mirrors 6 and 7 to a second carriage 41*b*. On the surface of first carriage 41*a*, a yellow line tape as scale 53 is adhered so as to visibly through the transparent glass of document table 2 as shown in FIG. 2. Carriages 41*a* and 41*b* can move, guided by guide-rails 42*a* and 42*b* in the directions Da and Db. Scanning motor 33 which is a 4-phase pulse motor, drives a pulley 43. An endless belt 45 is wound around this pulley 43 and an idle pulley 44. One end 41*c* of first carriage 41*a*, on to which exposure lamp 4 and mirror 5 are fixed, is secured to this belt 45. A guide 46 forms an intergral part of second carriage 41*b*, on to which mirrors 6 and 7 are fixed. This guide 46 straddles guide rail 42*b* and can move back and forth along it. Two pulleys 47 and 47 are mounted on this guide part 46 with a space between them in such a way that they can rotate in the axial direction of rail 42*b*. A wire 48 is wound around these pulleys 47 and 47, one end of this wire 48 being secured to a fixing piece 49, and the other to fixing piece 49 via a coil spring 50. As scanning motor 33 rotates, belt 45 revolves and first carriage 41*a* is moved, and with it second carriage 41*b*** also.

When this happens, since pulleys 47 and 47 perform the function of a fall block, second carriage **41*b* moves at half the speed of first carriage 41*a*, in the same direction. The direction in which first and second carriages 41*a* and 41*b* move is controlled by switching the direction of rotation of scanning motor 33**.

First carriage **41*a* is moved to a set position (a position indicating the width of the range over which copying is possible) as a result of motor 33 being driven in accordance with the copy paper size, magnification and book document specification. Also, when a book document has been designated, first carriage 41*a* can be moved in direction Da (leftwards) or in direction Db (rightwards) from this set position as the result of motor 33 being driven in response to actuation of displacement key 30*c* or 30*d*. On depression of copy button 30*e*, first, first carriage 41*a* moves towards second carriage 41*b* and then lamp 4 is lit and first carriage 41*a* moves in the direction in which it moves away from second carriage 41b. On completion of scanning of the document, lamp 4 is turned off and first carriage 41a returns to the abovenoted set position or to the position set by displacement key 30c or 30d**.

The area which can be copied, corresponding to the paper size that has been designated, is displayed on document table 2. If the size of the paper selected by the cassette selecting key 30h is taken as (Px, Py), and the rate of enlargement/reduction designated by rate setting key 30j or ZOOM key 30k as K, then the area can be copied (X, Y) is as follows.

$$X=Px/K$$

$$Y=Py/K$$

In this area that can be copied (X, Y), the X direction is indicated by pointers 51 and 52, while the Y direction is indicated by scale 53 on the top of first carriage 41a.

Figure 11:
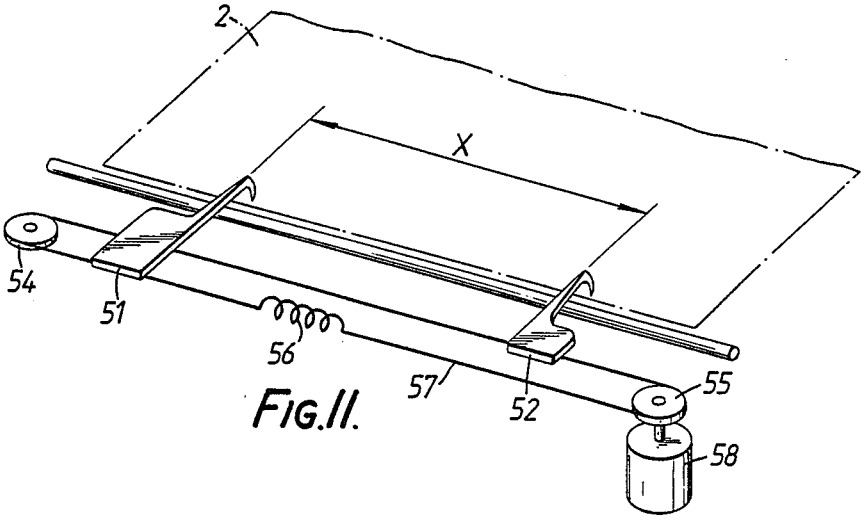

As shown in FIG. 11, pointers 51 and 52 are fixed to a wire 57 wound around pulleys 54 and 55 via a coiled spring 56. A pulley 55 receives rotary drive from motor 58. The distance between the pointer 51 and pointer 52 is altered by the rotation of motor 58 in response to the selection of paper size and the enlargement/reduction rate.

Figure 12:
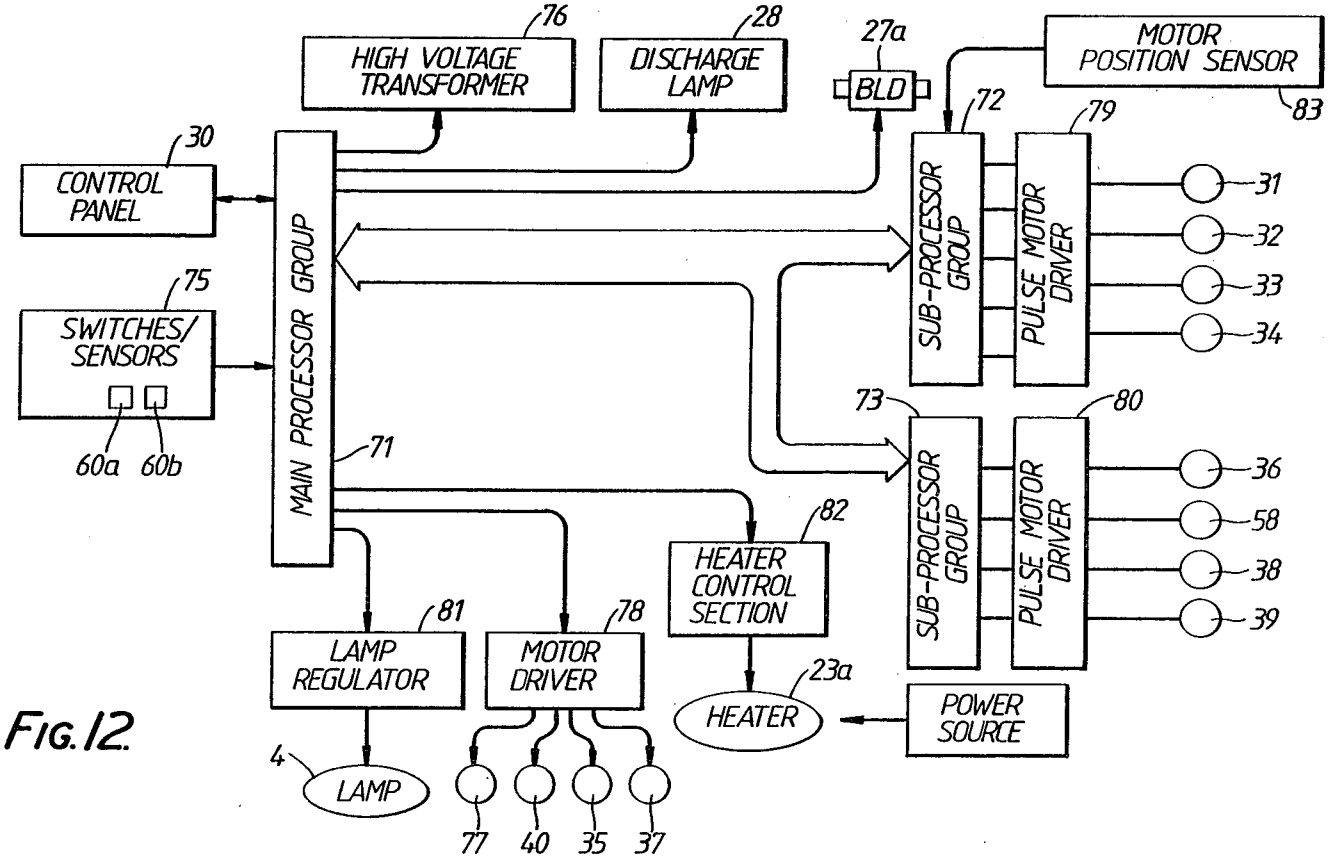

FIG. 12 shows the entire control circuit. The principal components of this circuit are a main processor group 71 and first and second sub-processors 72 and 73. Main processor group 71 executes the copying operation described above by detecting the inputs from operation panel 30 and an input device 75 containes various switches or sensors, e.g., cassette size sensors 60a and 60b, and by controlling a high voltage transformer 76 (which energizes the various charger), discharge lamp 28, a blade solenoid 27a of cleaner 27, a heater 23a of pair of fixing rollers 23, exposure lamp 4 and motors 31 through 40, 58 and 77.

Of motors mentioned above 35, 37, 40 and a toner motor 77 (for feeding toner to developing unit 12) are controlled by main processor group 71 via a motor driver 78. Motors 31 through 34 are controlled by first sub-processor 72 via a pulse motor driver 79. Motors 36, 38, 39 and 58 are controlled by second sub-processor 73 via a pulse motor driver 80. Exposure lamp 4 is controlled by main processor group 71 via a lamp regulator 81. Heater 23a is controlled by main processor group 71 via a heater controller 82. 'Run' or 'Stop' instructions for the various motors are sent from main processor group 71 to first and second sub-processors 72 and 73. A status signal indicating a 'Run' state or a 'Stop' state is sent from sub-processors 72 and 73 to main processor group 71. Position information from motor phase sensor 83, which detects each initial position of motors 31–34, is input into first sub-processor 72.

Figure 13:
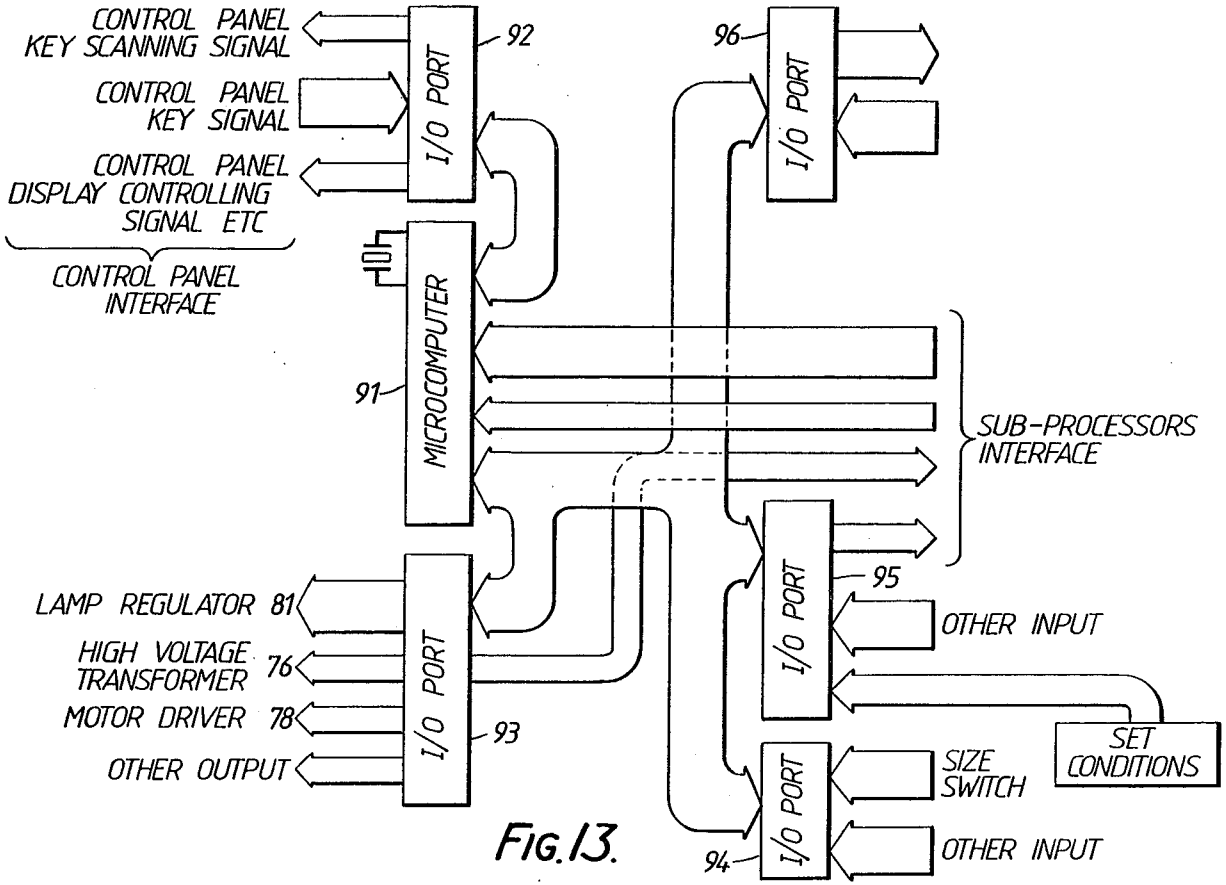

FIG. 13 shows an arrangement of main processor group 71. Reference number 91 denotes a one-chip microcomputer (to be referred to as a CPU hereinafter). CPU 91 detects key inputs at a control panel (not shown) through an I/O port 92 and controls display operations. CPU 91 can be expanded through I/O ports 93 to 96. Port 93 is connected to a high voltage transformer 76, a motor driver 78, a lamp regulator 81 and other outputs. Port 94 is connected to cassette size sensors 60a and 60b for detecting a paper size and other inputs. Port 95 is connected to a copying condition setting switch and other inputs. Port 96 is optional.

Figure 14:
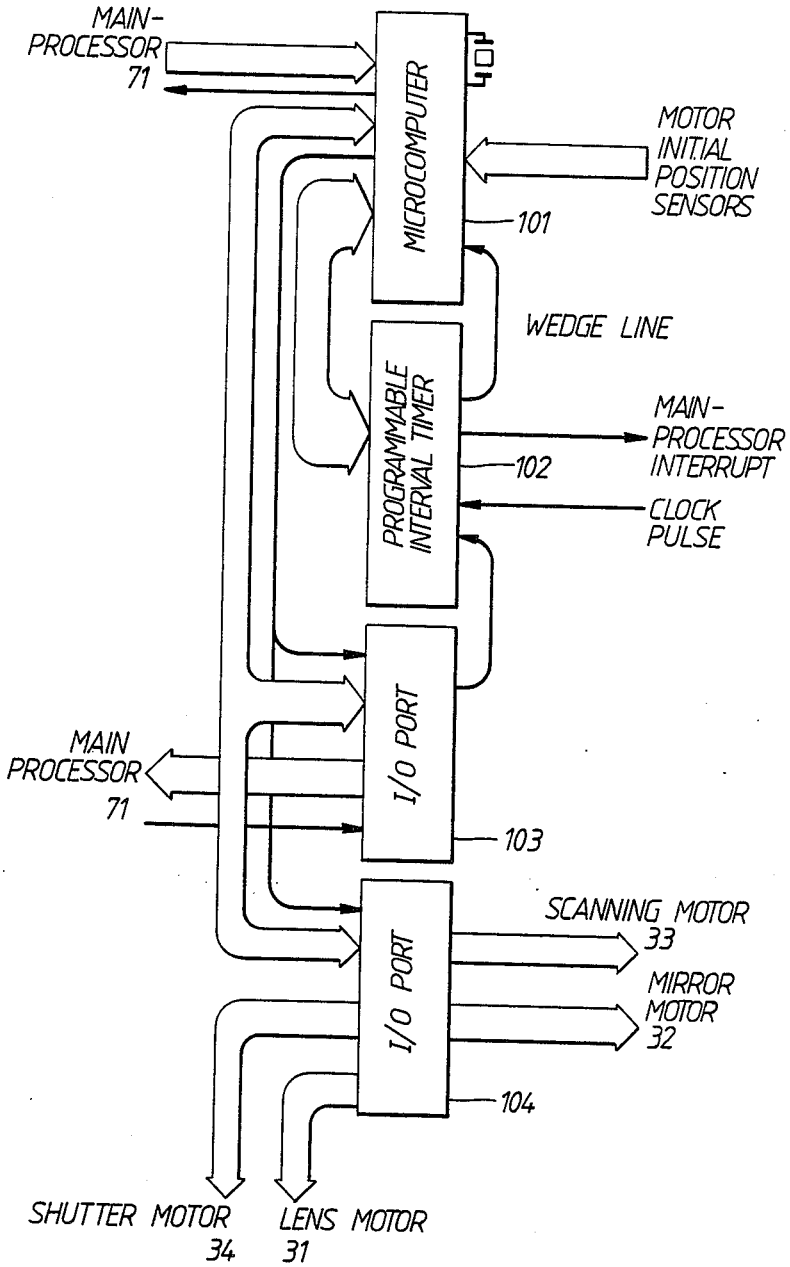

FIG. 14 shows an arrangement of first sub-processor group 72. Reference numeral 101 denotes a CPU connected to group 71. Reference numeral 102 denotes a programmable interval timer for controlling switching time intervals. A preset value from CPU 101 is set in programmable interval timer 102, and timer 102 started. When timer 102 is stopped, timer 102 sends an end pulse onto an interrupt line of CPU 101. Timer 102 receives a reference clock pulse. CPU 101 receives position data from a position sensor 83 and is connected to I/O ports 103 and 104. Port 104 is connected to motors 31 to 34 through pulse motor driver 79. Port 103 is used to supply a status signal from each pulse motor to group 71.

Figure 15:
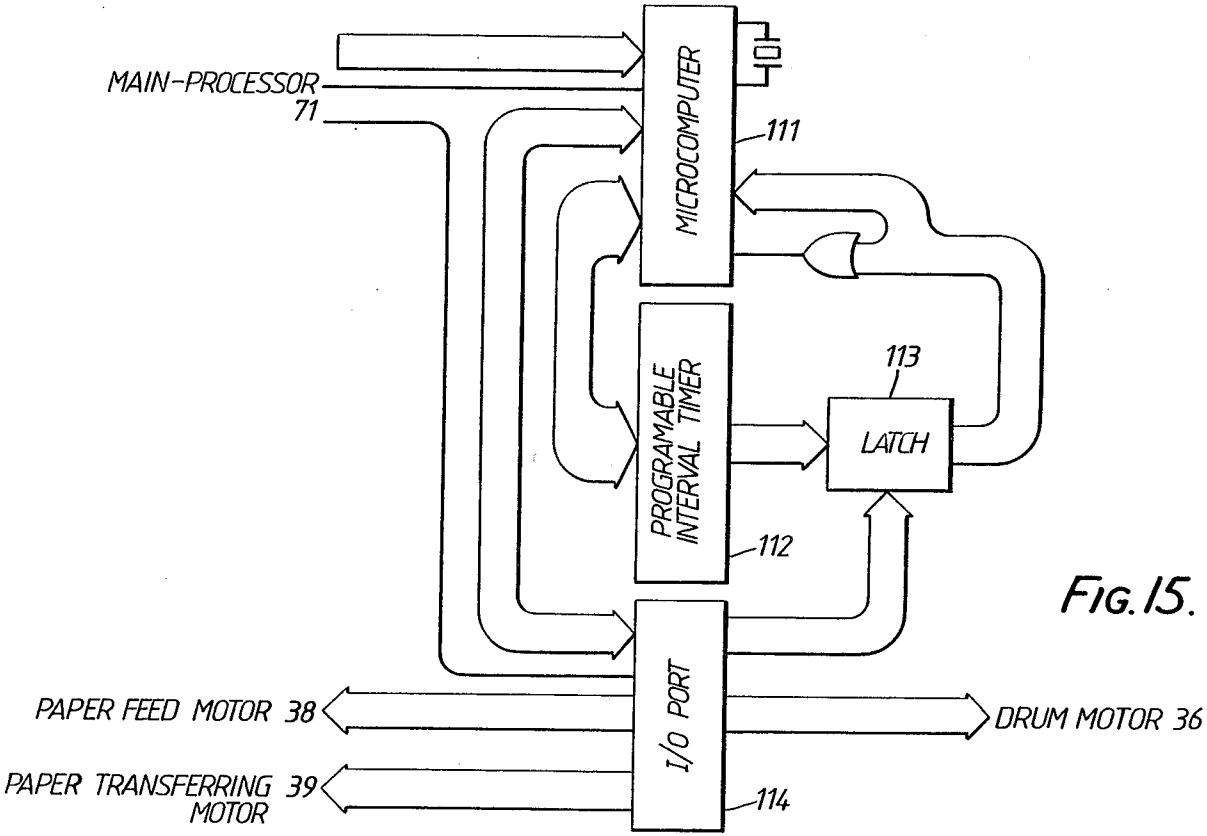

FIG. 15 shows an arrangement of second sub-processor group 73. Reference numeral 111 denotes a CPU connected to group 71. Reference numeral 112 denotes a programable interval timer for controlling switching time intervals of the pulse motors. A preset value from CPU 111 is set in programmable interval timer 112, and timer 112 is started. When timer 112 stopped, it generates an end pulse. The end pulse is latched by a latch circuit 113, and an output therefrom is supplied onto the interrupt line of CPU 111 and the input line of the I/O port. CPU 111 is connected to an I/O port 114 which is then connected to motors 36, 38, 39 and 58 through pulse motor driver 80.

Figure 16:
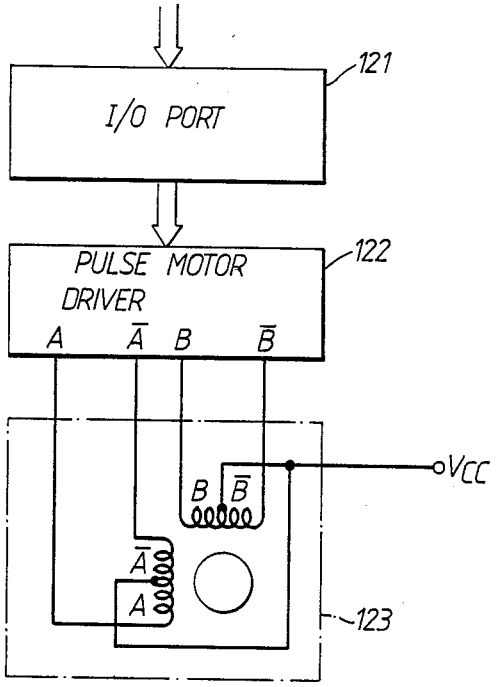

FIG. 16 shows a pulse motor control circuit. An I/O port 121 (corresponding to ports 104 and 114 in FIGS. 14) is connected to a pulse motor driver 122 (corresponding to drivers 79 and 80 in FIG. 12). Driver 122 is connected to windings A, $\overline{A}$, B and $\overline{B}$ of a pulse motor 123 (corresponding to motors 31 through 34, 36, 38, 39 and 58).

Figure 17A:
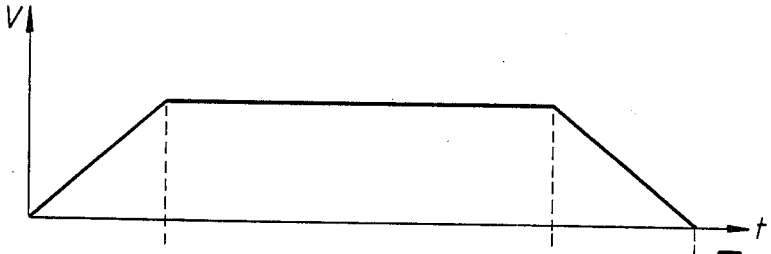
Figure 17B:
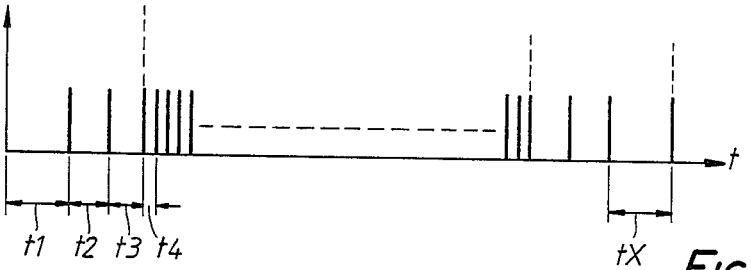

FIGS. 17A and 17B show a method of controlling a pulse motor speed. FIG. 17A shows a pulse motor speed curve, and FIG. 17B shows switching intervals. As is apparent from FIGS. 17A and 17B, the switching intervals are long at the beginning, are gradually decreased, and finally stop to decrease. Then, the intervals are prolonged, and the pulse motor is finally stopped. This cycle indicated the through-up and through-down of the pulse motor. The motor is started from the self starting region, operated in a high-speed region and is gradually stopped. Reference symbols t1, t2, - - - , tx denote times between the switching intervals.

There now follows a description of operation in the above structure given with reference to FIGS. 2 through 5B. For example, after switch-on of power, a check is made in response to a signal from main processor group 71 to see if there is any copy paper P remaining on the copy paper transport path. If there is no paper remaining, main processor group 71 ascertains from a signal from detection switch 60a that the copy paper size is to be the size of the copy paper in upper cassette 13 and having ascertained this, outputs corresponding signals indicating the copy paper P length and width and an optical system initialization signal to CPU 101. Hereupon, CPU 101 actuates motor 33 via pulse motor driver 79 to move first and second carriages 41a and 41b and at the same time pointers 51 and 52 are moved by actuation of motor 58.

CPU 101 actuates motor 33 to cause movement for a set time after an initial position detection signal has been output from position sensor 83, this being the time for scale 53 to come to a position (point A) that represents the length of copy paper in the direction of transport (i.e., the range over which copying is possible in the y direction). CPU 101 also actuates motor 58 to cause movement for a set time after an initial position detection signal has been output from position sensor 83, until pointers 51 and 52 come to indicate the copy paper width (i.e., the range over which copying is possible in the x direction).

CPU 101 completes initialization by acting through pulse motor driver 79 to actuate lens motor 31, mirror motor 32 and shutter motor 34 to move the lens, mirrors and shutter to initial positions and then move them to positions for same-size copies. Also, when the power is connected, main processor group 71 actuates motor driver 78 to actuate fan motor 40 and controls heater control section 82 to turn heater 23*a* on. Once heater 23*a* has reaching a temperature permitting fixing, main processor group 71 causes an indication that copying is possible to be given.

In this state, if copying of each page is to be effected for a size B5 book that has been opened up (size B4) as shown in FIG. 2, first, the operator actuates book designation key 30*a*. This notifies main processor group 71 that book document copying (dual-page copying) is to be effected and main processor group 71 therefore sets the mode the book document mode. Hereupon, as shown in FIGS. 3A and 3B, CPU 101 actuates motor 33 via pulse motor driver 79 to move first carriage 41*a* and set it at point B, which indicates the range over which copying is possible with two sheets of the specified copy paper (which together with fixed scale 2*a* indicates the width in the transverse direction, i.e., Y direction).

For example, if book designation key 30*a* is actuated when the upper cassette containing size B5 copy paper has been selected, main processor group 71 causes indicator 30*b* to light up. And then main processor group 71 acts through CPU 101 to actuate motor 33 and move first carriage 41*a* in direction Db away from point A and set it at point B corresponding to size B4 width (the width of the book when it is opened up), as shown if FIG. 3A.

Figure 3A:
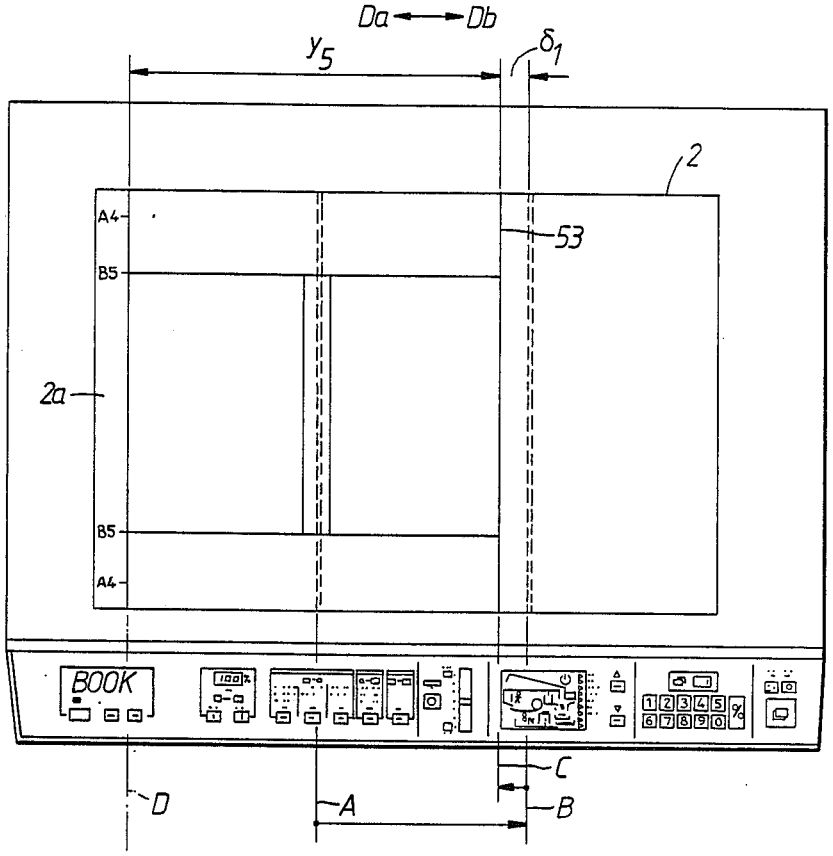
FIG. 3A is a plan view for explaining movement of a cursor.
Figure 3B:
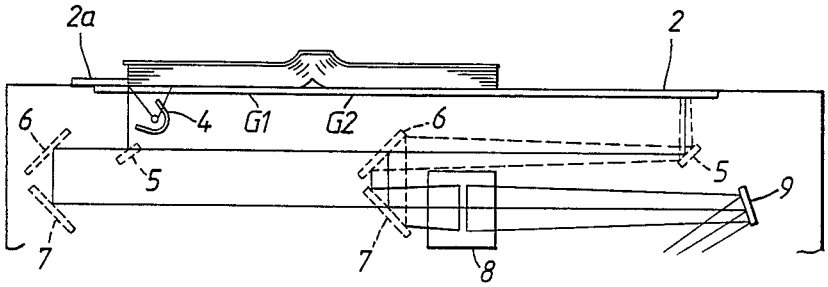
FIG. 3B is a schematic elevation showing a book placed on a document table.

In response to this indication, the operator sets the book surfaces that are to be copied inside the possible copying range as shown in FIG. 2 and FIGS. 3A and 3B and then uses displacement key 30*c* or 30*d* to move scale 53 to point C, i.e., an amount $\delta 1$ to the left. That is, main processor group 71 actuates motor 33 in response to actuation of displacement key 30*c* or 30*d* and so moves first carriage 41*a* to bring scale 53 from point B to point C. As a result, fixed scale 2*a* and scale 53 at point C together indicate the book's actual width (y5).

Figure 4A:
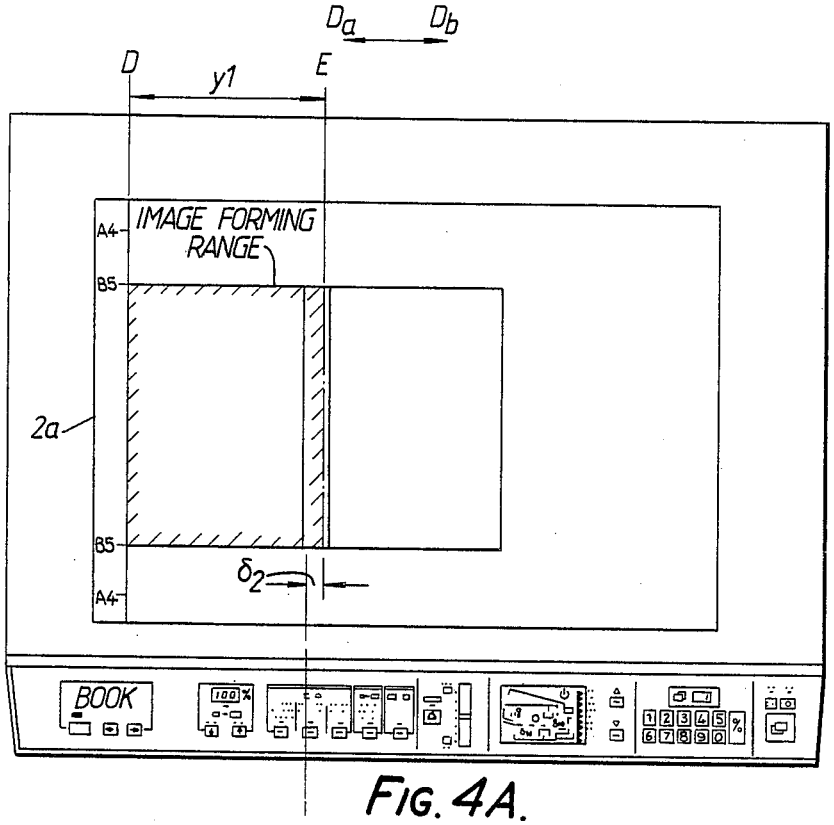
FIGS. 4A and 4B are plan view and schematic elevation for explaining an image forming range of left-hand page of the book.
Figure 4B:
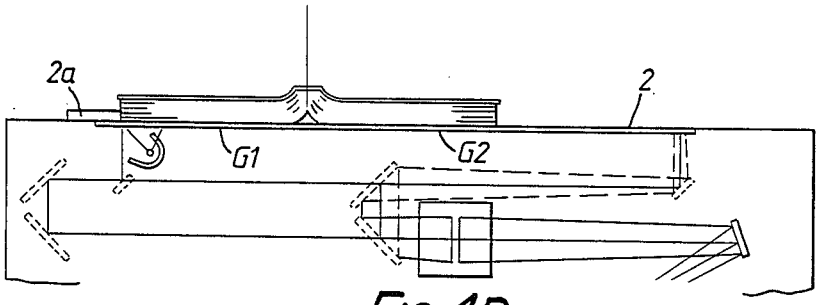

After this, the operator actuates COPY button 30*e*. Hereupon main processor group 71, having determined that the operation is to be dual-page copying of size B5 pages of a book document, communicates this finding to CPU 101. Therefore, CPU 101 actuates motor 33 to move first and second carriages 41*a* and 41*b* in direction Da. As shown in FIGS. 4A and 4B, when carriages 41*a* and 41*b* are reached at point D, CPU 101 drives motor 33 in reverse and so moves first and second carriages 41*a* and 41*b* in direction Db to point E (which is set off a distance $\delta 2$ from the center of the book). The interval point D–point E here corresponds to the width (Y1) of a size B5 image forming range determined with reference to fixed scale 2*a*. CPU 91 effects control to light exposure lamp 4 during this process.

As a result, the left-hand page G1 of the book is illuminated by light from exposure lamp 4. Light reflected from the left-hand page G1 goes via mirror 5, 6 and 7 and lens block 8 to mirror 9, which reflects it onto photosensitive drum 10, so forming an electrostatic latent image of the left-hand page G1 on photosensitive drum 10. As photosensistive drum 10 rotates, this electrostatic latent image is brought to development unit 12 and developed. During this process, copy paper P is taken out of paper supply cassette 13 and forwarded via aligning rollers 19 to between photosensitive drum 10 and transfer charger 20, and as result of the action of transfer charger 20 the developed image on photosensitive drum 10 is transferred onto copy paper P at this location, this transfer being followed by separation by the action of separation charger 21. Copy paper P on which the image has thus been transferred is then carried by movement of transport belt 22 to fixing rollers 23 and, after fixing of the image here, is fed out by the exit rollers 24. Then, the next sheet of copy paper P is taken out from paper supply cassette 13 and brought to aligning rollers 19.

Figure 5A:
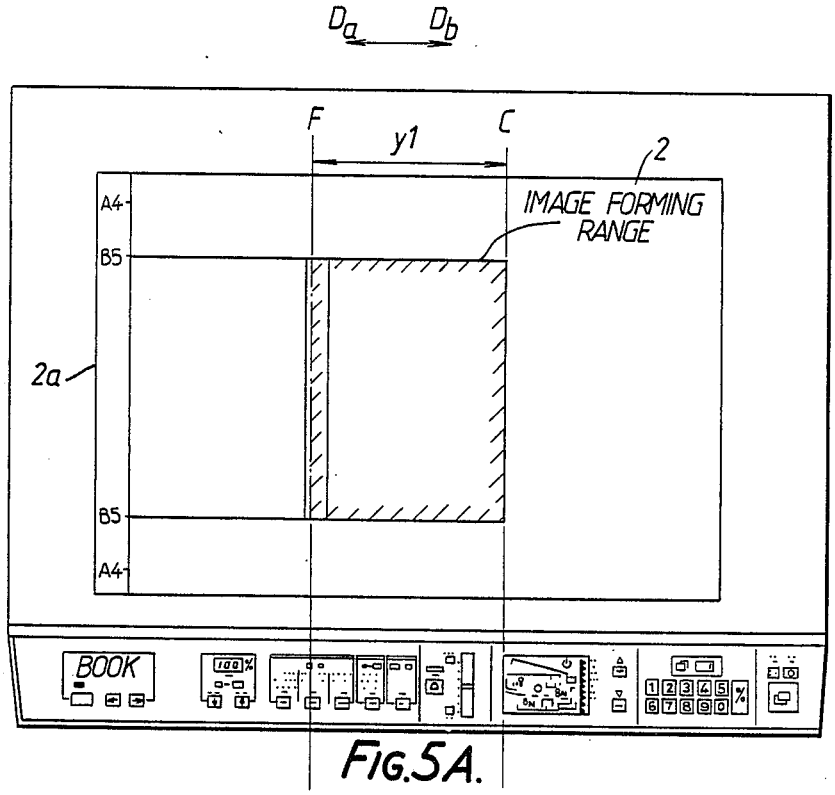
FIGS. 5A and 5B are plan view and schematic elevation for explaining an image forming range of right-hand page of the book.
Figure 5B:
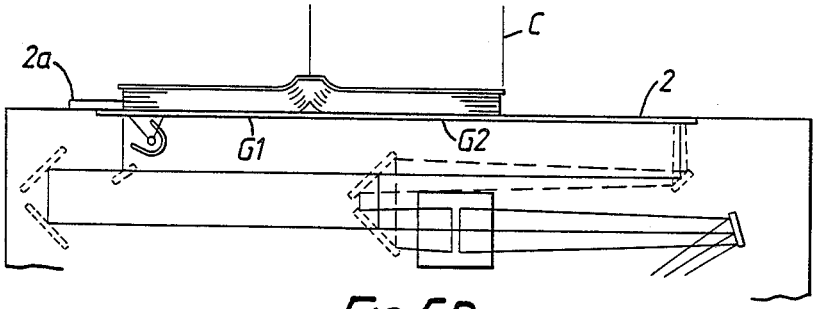

Next, as shown in FIGS. 5A and 5B, CPU 101 actuates motor 33 to cause first and second carriages 41*a* and 41*b* to move from point F, which is slightly back from point E going in direction Da, to point C. The interval point F - point C here corresponds to the width (Y1) of a size B5 image forming range determined with reference to scale 53. CPU 91 effects control to light exposure lamp 4 during this process.

As a result, the right-hand page G2 of the book is illuminated by light from exposure lamp 4. Light reflected from the right-hand page G2 goes via mirror 5, 6 and 7 and lens block 8 to mirror 9, which reflects it onto photosensitive drum 10, so forming an electrostatic latent image of the left-hand page G1 on photosensitive drum 10. As photosensitive drum 10 rotates, this electrostatic latent image is brough to development unit 12 and developed. During this process, copy paper P already guided to aligning rollers 19 is fed to between photosensitive drum 10 and transfer charger 20, and as result of the action of transfer charger 20 the developed image on photosensitive drum 10 is transferred onto copy paper P at this location, this transfer being followed by separation by the action of separation charger 21. Copy paper P on which the image has thus been transferred is then carried by movement of transport belt 22 to fixing rollers 23 and, after fixing of the image here, is fed out by the exit rollers 24.

If plural copies are to be made, first, plural copies of the left-hand page G1 are taken and then plural copies of the right-hand page G2 are taken.

Thus, when dual-page of a book are to be copied, specifying a book document prior to putting the book on result in scale indication of the possible copying range corresponding to the book when it is opened up, and this makes it easy to see where the book should be set and makes it possible to prevent mistakes by operators. Copying of a left-hand page of a book is effected over a B5 copying range determined taking a fixed scale, i.e., the left-hand edge of the book, as a reference, while copying of a right-hand page of the book is effected over a B5 copying range taking the right-hand edge of the book as a reference, and it is thus possible to produce fine copies that are free of offset.

What is claimed is:

1. An image forming apparatus comprising:

a document table on which a document having first and second areas is positioned;

optical scanning means for respectively optically scanning said first and second areas of said document in a prescribed range defined by a scanning start position and a scanning end position corresponding to each of said first and second areas;

first scale means fixedly provided at one end of said document table as an indicator for positioning a first edge of said document, said first scale means defining the scanning start position of said first area;

second scale means movably provided along said document table for indicating a second edge of said document opposed to said first edge, said second scale means thereby defining the scanning end position of said second area;

displacement means for moving said second scale means to a position corresponding to said second edge of said document;

means for controlling the scan of said optical scanning means, to optically scan said first area of said document in said prescribed range defined by said first scale means which corresponds to the scanning start position of said first area, and said scanning end position of said first area, and to optically scan said second area of said document in said prescribed range defined by the scanning start position of said second area and said second scale means positioned at said second edge, which corresponds to the scanning end position of said second scanning area; and means for producing respective copies of each area of said document respectively scanned by said optical scanning means.

2. An apparatus according to claim 1, further comprising a designating means for designating the plural images formation corresponding to said first and second areas of said document.

3. An apparatus according to claim 1, wherein said displacement means includes an operator control means for manually controlling the displacement of said second scale means.

4. An apparatus according to claim 1, wherein said document comprises a opened book having a left-hand page corresponding to said first area and a right-hand page corresponding to said second area.

5. An apparatus according to claim 1, wherein said document table is stationaly provided, and said optical scanning means is movable provided along said document table.

6. An apparatus according to claim 1, wherein said document table includes a transparent glass, and said second scale means includes a line provided on said optical scanning means visible through said transparent glass of said document table.

* * * * *